US009236053B2

(12) United States Patent
Ishikawa et al.

(10) Patent No.: US 9,236,053 B2
(45) Date of Patent: Jan. 12, 2016

(54) ENCODING AND DECODING SYSTEM, DECODING APPARATUS, ENCODING APPARATUS, ENCODING AND DECODING METHOD

(71) Applicant: Panasonic Corporation, Osaka (JP)

(72) Inventors: Tomokazu Ishikawa, Osaka (JP); Takeshi Norimatsu, Hyogo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 21 days.

(21) Appl. No.: 14/241,541

(22) PCT Filed: Jun. 21, 2013

(86) PCT No.: PCT/JP2013/003908

§ 371 (c)(1),
(2) Date: Feb. 27, 2014

(87) PCT Pub. No.: WO2014/006837

PCT Pub. Date: Jan. 9, 2014

(65) Prior Publication Data

US 2015/0039323 A1 Feb. 5, 2015

(30) Foreign Application Priority Data

Jul. 5, 2012 (JP) ..... 2012-151463

(51) Int. Cl.

| | |
|---|---|
| ***G10L 19/008*** | (2013.01) |
| ***G10L 19/00*** | (2013.01) |
| ***G10L 19/005*** | (2013.01) |
| *G10L 19/18* | (2013.01) |

(52) U.S. Cl.
CPC ..... *G10L 19/0017* (2013.01); *G10L 19/005* (2013.01); *G10L 19/18* (2013.01)

(58) Field of Classification Search
CPC .... G10L 19/0017; G10L 19/005; G10L 19/18
USPC ..... 704/500–504
See application file for complete search history.

(56) References Cited

U.S. PATENT DOCUMENTS 5,627,935 A * 5/1997 Kim ..... H04N 9/8042 386/263
5,802,487 A 9/1998 Tanaka
(Continued)

FOREIGN PATENT DOCUMENTS

EP 0 708 435 4/1996
WO 2012/020828 2/2012

OTHER PUBLICATIONS

International Search Report issued Jul. 30, 2013 in corresponding International (PCT) Application No. PCT/JP2013/003908.
(Continued)

*Primary Examiner* — Marcellus Augustin
(74) *Attorney, Agent, or Firm* — Wenderoth, Lind & Ponack, L.L.P.

(57) ABSTRACT

An encoding and decoding system includes: a characteristic determining unit which determines whether a sound signal is a speech signal or an audio signal; an encoder which encodes the sound signal into an encoded signal, based on a determination by the characteristic determining unit; a transmitting unit which transmits the encoded signal; a receiving unit which receives the encoded signal; a decoder which decodes the encoded signal; and a packet loss detecting unit which detects a loss of data of the encoded signal and transmits a notification indicating the loss of the data to the characteristic determining unit. Upon receiving the notification indicating the loss of the data, the characteristic determining unit causes the encoder to encode the sound signal portion into a signal portion composed of independently decodable frames.

13 Claims, 14 Drawing Sheets

(56) References Cited

U.S. PATENT DOCUMENTS

| | | | | |
|---|---|---|---|---|
| 7,802,168 | B1 * | 9/2010 | Apostolopoulos | H04N 19/105 375/240.03 |
| 2005/0259613 | A1 * | 11/2005 | Garudadri et al. | 370/328 |
| 2012/0265523 | A1 * | 10/2012 | Greer et al. | 704/201 |
| 2012/0327779 | A1 * | 12/2012 | Gell et al. | 370/238 |
| 2013/0159005 | A1 | 6/2013 | Kikuiri et al. | |

OTHER PUBLICATIONS

Martin Wolters et al.; "A closer look into MPEG-4 High Efficiency AAC"; AES Convention Paper, Presented at the 115th Convention, New York; Oct. 10-13, 2003.

Milan Jelinek et al.; "Wideband Speech Coding Advances in VMR-WB Standard", IEEE Transactions on Audio, Speech, and Language Processing, vol. 15, No. 4; May 2007, pp. 1167-1179.

Max Neuendorf et al.; "A Novel Scheme for Low Bitrate Unified Speech and Audio Coding—MPEG RM0"; AES Convention Paper 7713, presented at the 126th Convention, Munich Germany, May 7-10, 2009.

Transmission System for Digital Terrestrial Television Broadcasting; ARIB Standard; ARIB STD-B31, version 1.9; Association of Radio Industries and Businesses, Jul. 15, 2010 (with partial English translation).

TS 126 191 V10.0.0 (Apr. 2011); (3GPP TS 26.191 version 10.0.0 Release 10); European Telecommunications Standards Institute.

* cited by examiner

ENCODING AND DECODING SYSTEM, DECODING APPARATUS, ENCODING APPARATUS, ENCODING AND DECODING METHOD

TECHNICAL FIELD

The present invention relates to an encoding and decoding system for efficiently encoding and decoding an audio signal and a speech signal.

BACKGROUND ART

Schemes and formats for encoding and decoding digital speech or audio signals (hereinafter also referred to as sound signals) have been conventionally known. Representatives are the High-Efficiency Advanced Audio coding (HE-AAC) (see Non-patent Literature 1) and the Adaptive Multi-Rate Wideband (AMR-WB) format (see Non-patent Literature 2). Recently, the Unified Speech and Audio Coding (MPEG-USAC) (see Non-patent Literature 3, hereinafter referred to as USAC) has appeared which enables encoding of speech signals and audio signals with an increased efficiency.

CITATION LIST

Patent Literature

Non Patent Literature

[NPL 1]
AES Convention Paper "A closer look into MPEG-4 High Efficiency AAC"
[NPL 2]
IEEE TRANSACTIONS ON AUDIO, SPEECH, AND LANGUAGE PROCESSING, VOL. 15, NO. 4, May 2007 "Wideband Speech Coding Advances in VMR-WB Standard"
[NPL 3]
AES Convention Paper 7713 "A Novel Scheme for Low Bitrate Unified Speech and Audio Coding—MPEG RM0"
[NPL 4]
STD-B31
[NPL 5]
TS26.191

SUMMARY OF INVENTION

When transmitting an encoded signal obtained by encoding a sound signal using one of the aforementioned schemes and format using an unstable transmission path for broadcasting or through the Internet, a transmission error may occur in the transmission path which leads to a decoder side, resulting in a loss of a frame of the encoded signal. In this case, the decoder side may have difficulty in immediately decoding a frame incoming normally after the error.

The present invention aims to provide an encoding and decoding system which makes it possible to re-start decoding as soon as possible after an occurrence of a frame loss.

In order to solve the above problem, an encoding and decoding system according to an aspect of the present invention an encoding and decoding system which encodes a sound signal into an encoded signal and decodes the encoded signal, the encoding and decoding system including: a characteristic determining unit configured to determine whether the sound signal is a speech signal or an audio signal, based on an audio characteristic of the sound signal; an encoder which encodes the sound signal by performing a speech signal encoding process when the sound signal is determined to be the speech signal by the characteristic determining unit, and encodes the sound signal by performing an audio signal encoding process when the sound signal is determined to be the audio signal by the characteristic determining unit; a transmitting unit configured to transmit the encoded signal; a receiving unit configured to receive the encoded signal transmitted by the transmitting unit; a decoder which decodes the encoded signal received by the receiving unit; and a packet loss detecting unit configured to detect a loss of data of the encoded signal in the reception of the encoded signal by the receiving unit, and transmit a notification indicating the loss of the data to the characteristic determining unit, wherein, when receiving the notification indicating the loss of the data, the characteristic determining unit is configured to cause the encoder to encode a portion of the sound signal to have a predetermined structure, and the portion encoded to have the predetermined structure in the encoded signal corresponds to one or more frames, and all of the frames are independently decodable by the decoder.

These general and specific aspects may be implemented using a system, a method, an integrated circuit, a computer program, or a computer-readable recording medium such as a CD-ROM, or any combination of systems, methods, integrated circuits, computer programs, or computer-readable recording media.

The encoding and decoding system according to the present invention makes it possible to re-start decoding as soon as possible after an occurrence of a frame loss, to thereby minimize a sound loss resulting from the frame loss.

DETAILED DESCRIPTION OF INVENTION

Figure 1:
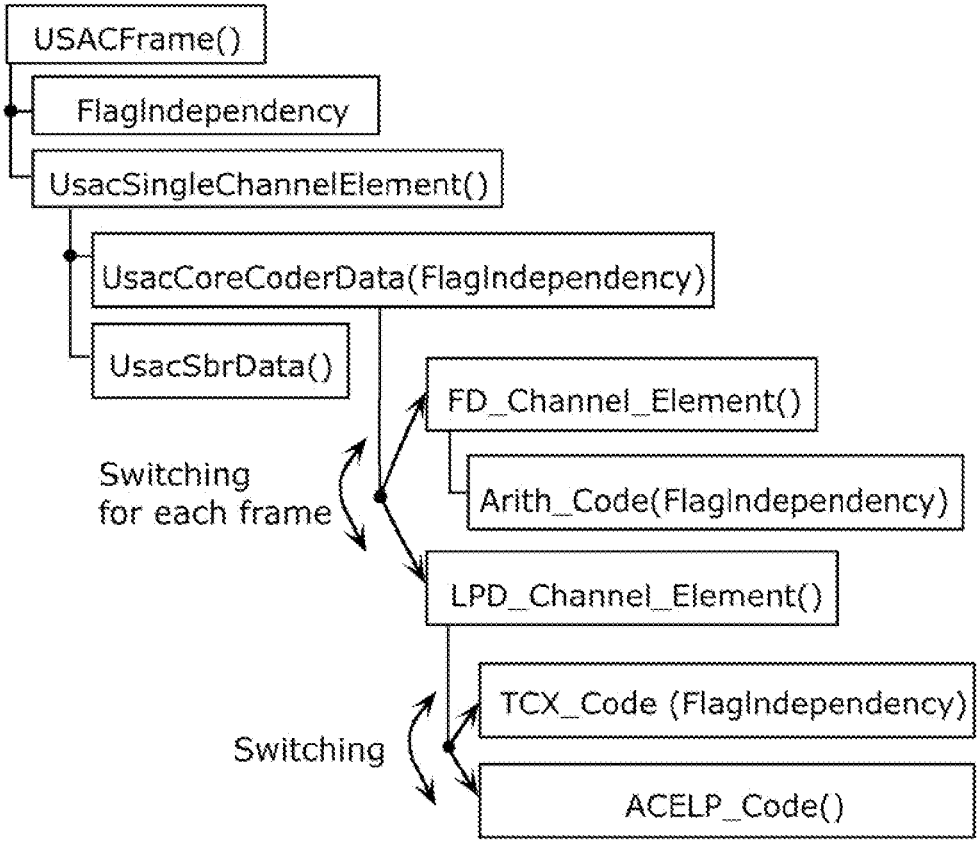
FIG. 1 is a schematic diagram showing a data structure of a frame according to the USAC.

Underlying Knowledge Forming Basis of the Present Disclosure

Representative schemes and formats for encoding, decoding, and transmitting digital speech and audio signals with low bit rates include the HE-AAC (see Non-patent Literature 1) and the AMR-WB (see Non-patent Literature 2).

The HE-AAC is intended to perform time-frequency transform for each predetermined number of samples in a digital audio signal (in the HE-AAC, for every 2048 samples which are referred to as a frame), and determine a signal component to be encoded using psychoacoustic model. The signal component determined to be encoded is subject to quantization, and the information of the quantized signal is compressed to a predetermined number of bits using Huffman coding or the like.

The CELP represented by the ACELP is intended to process a speech signal on a per frame basis as in the HE-AAC without performing any time—frequency transform. The AMR-WB and the ACELP compress information by calculating at least one linear prediction coefficient for each frame, and applying a linear prediction filter based on the coefficients and vector quantization on the residual signal.

The information having information compressed in this way is referred to as a bitstream. Such bitstream is transmitted via various transmission paths in the form of a broadcast wave or through the Internet. A receiving apparatus side decodes the transmitted bitstream according to the scheme used to encode the bitstream.

The HE-AAC is suitable for efficiently encoding audio signals, and the AMR-WB is suitable for efficiently encoding speech signals.

The HE-AAC is an encoding scheme intended to mainly encode audio signals highly efficiently. For this reason, according to the HE-AAC, it is difficult to encode speech signals different in characteristics from audio signals to achieve high sound quality with low bit rates. The HE-AAC can be used to encode speech signals, but yields a significantly reduced sound quality.

On the other hand, the AMR-WB and the ACELP are intended to mainly encode speech signals highly efficiently. For this reason, when an audio signal is encoded according to the AMR-WB or the ACELP, the encoded audio signal has a noticeably reduced sound quality. In other words, each scheme has the advantage and the disadvantage for encoding-target signals.

In view of this, encoding schemes have recently been developed which are capable of encoding both types of signals that are speech signals and audio signals highly efficiently. One of the schemes is the MPEG-USAC.

The USAC employs various processes for enhancing encoding efficiency. In order to encode speech signals and audio signals or signals in which speech signals and audio signals are mixed, the USAC is intended to switch, for each frame, between the encoding process for audio signals based on time—frequency transform and the encoding process for speech signals based on at least one linear prediction coefficient. In other words, the USAC encodes an input sound signal according to audio characteristics thereof. In addition, in order to pursue encoding efficiency, the USAC is characterized by using arithmetic encoding instead of information compression using the Huffman coding which has been used in conventional encoding schemes.

As described above, there are various schemes for encoding sound signals, and each of the encoding schemes, broadcasting services, and communication services has a unique problem which arises when the speech signals are transmitted in the forms of broadcast waves or through communication networks.

Transmission paths for broadcast waves and internets (IP networks) as transmission paths are instable, and thus transmission errors and packet losses frequently occur. Thus, for example, the ARIBSTD-B31 (Standard name: Transmission System For Digital Terrestrial Television Broadcasting, Non-patent Literature 4) which is a working standard for terrestrial television broadcasting (ISDB-T) defines a transmission error correction method etc. for use in digital television broadcasting. In addition, the AMR-WB defines 3GPP Standard (TS26.191, Non-patent Literature 5) which is an approach for detecting and correcting an error that occurs when the AMR-WB is used in a 3G mobile telephone.

In this way, when transmitting and receiving speech or audio signals by broadcasting or communication, there is a need to precisely define data items related to transmission error detection and error correction other than various kinds of encoding parameters such as a bit rate, the number of channels, an encoding tool, etc.

The ISDB-T involves the HE-AAC as a scheme for encoding sound signals, and detects and corrects a transmission error occurred in a transmission path at the time of receiving a broadcast wave and extracting a TS packet therefrom. More specifically, a speech signal is decoded from an AAC bitstream extracted from the TS packet according to AAC decoding. However, according to the ISDB-T, it is impossible to receive TS packets normally due to data loss or data error in a transmission path, which may result in a loss of the AAC bitstream. In case of the loss of the bitstream, it is impossible to decode the encoded signal as a matter of course, and to obtain an expected sound signal.

However, when successful reception of TS packets is restarted, a normal AAC bitstream is extracted from a TS packet received immediately after a return and is transmitted to a decoding apparatus, so that the decoding apparatus can restart decoding Immediately. Furthermore, a decoded sound fades in by nature of the frequency—time transform involved in the HE-AAC, and a sound which is immediately after the return is comparatively clear.

In addition, Non-patent Literature 5 discloses a procedure related to error detection in a transmission path and transmission error correction according to the AMR-WB which is expected to be applicable to 3G generation mobile phones. Briefly, in the procedure, frame data normally received before a frame loss occurs is temporarily stored in a memory in a decoding apparatus. In the case of the frame loss, a decoding signal portion corresponding to the lost frame is pseudo-generated using parameters obtained by performing a predetermined operation on encoded parameters of data of a past frame.

This approach can be taken because the AMR-WB is intended to mainly encode speech signals. Among encoded parameters of a speech signal, linear prediction coefficients which roughly determine the spectrum outer shape of the speech signal and significantly affect speech encoding quality do not change so much in a short period (or change slightly). Accordingly, it is possible to re-use the linear prediction coefficients at the time of a frame data loss in such a short period, and thus to take the approach for pseudo-generating the decoded signal.

The HE-AAC uses Huffman codes for encoding and compressing spectrum information. Thus, according to the AAC which is the core encoding scheme in the HE-AAC, it is possible to always independently decode narrow-band AAC portions of each frame without obtaining encoded parameters across frames even when it is impossible to perform wide-band HE-AAC decoding. In addition, the AMR-WB also involves Huffman coding and a vector quantization approach both of which do not basically use any encoded parameter that places an influence across frames. Therefore, according to the AMR-WB, it is possible to decode every frame independently.

Here, unlike the HE-AAC and the AMR-WB, the USAC introduces arithmetic encoding in which various kinds of encoded parameters are compressed using operations across frames in order to increase the encoding efficiency. Accordingly, independently decodable frames are limited.

FIG. 1 is a schematic diagram showing a data structure of a frame according to the USAC.

As shown in FIG. 1, each of frames (USACFrame( )) according to the USAC includes, at its starting portion, a flag (FlagIndependency) indicating whether or not the frame can be independently decoded, that is, the frame can be decoded based only on the data of the frame. This flag is information which is used to read detailed encoded data (FD_Channel_Element ( )) in FIG. 1) included in the frame. The FD_Channel_Element ( ) is configured to allow obtainment of information (Arith_Code ( )) in an arithmetic encoder only when the flag can be decoded independently.

In this way, in the USAC, independently decodable frames are limited. Accordingly, when normal reception of frame data is re-started after a frame loss (packet loss), it is difficult to re-start decoding immediately.

Figure 2:
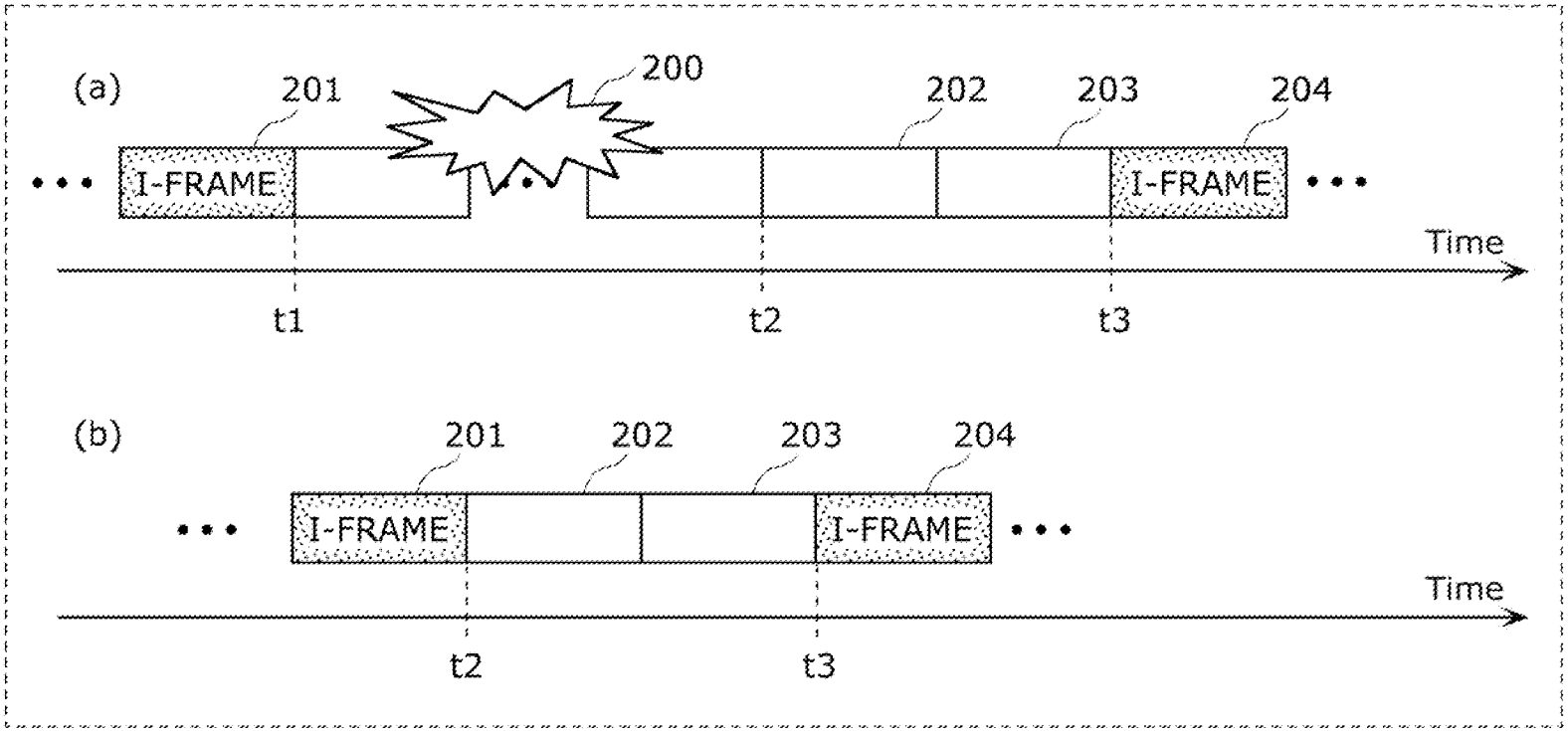
FIG. 2 shows schematic diagrams showing decoding after an occurrence of a packet loss.

FIG. 2 shows schematic diagrams showing decoding after an occurrence of a packet loss.

FIG. 2 schematically shows an encoded signal to be transmitted, and each of rectangles therein shows a frame. Each of the frames 201 and 204 denoted as I-Frame can be decoded independently.

As shown in (a) of FIG. 2, when a transmission error occurs at a timing t1, that is, when a packet loss 200 occurs, the frames before the transmission error is stopped cannot be received by a decoding side.

In other words, the decoding side receives frames as shown in (b) of FIG. 2. Here, since the frames 202 and 203 cannot be decoded independently, the decoding side cannot re-start decoding until a next independently decodable frame 204 is received at a timing t3 although the packet loss is stopped at a timing t2.

As described above, according to encoding schemes such as the USAC intended to decode an encoded signal including frames which can be decoded independently and frames which cannot be decoded independently, it is difficult to re-start decoding immediately after the normal reception of the frames is re-started after the packet loss.

In order to solve the above problem, an encoding and decoding system according to an aspect of the present invention is an encoding and decoding system which encodes a sound signal into an encoded signal and decodes the encoded signal, the encoding and decoding system including: a characteristic determining unit configured to determine whether the sound signal is a speech signal or an audio signal, based on an audio characteristic of the sound signal; an encoder which encodes the sound signal by performing a speech signal encoding process when the sound signal is determined to be the speech signal by the characteristic determining unit, and encodes the sound signal by performing an audio signal encoding process when the sound signal is determined to be the audio signal by the characteristic determining unit; a transmitting unit configured to transmit the encoded signal; a receiving unit configured to receive the encoded signal transmitted by the transmitting unit; a decoder which decodes the encoded signal received by the receiving unit; and a packet loss detecting unit configured to detect a loss of data of the encoded signal in the reception of the encoded signal by the receiving unit, and transmit a notification indicating the loss of the data to the characteristic determining unit, wherein, when receiving the notification indicating the loss of the data, the characteristic determining unit is configured to cause the encoder to encode a portion of the sound signal to have a predetermined structure, and the portion encoded to have the predetermined structure in the encoded signal corresponds to one or more frames, and all of the frames are independently decodable by the decoder.

In this way, the encoder encodes the sound signal into the Independently decodable encoded signal when the loss of the data occurs, which makes it possible to minimize the time duration in which the decoder cannot decode the encoded signal, to thereby minimize the loss of the sound resulting from the loss of the data.

In addition, for example, when receiving the notification indicating the loss of the data, the characteristic determining unit may be configured to cause the encoder to encode the portion of the sound signal to have the predetermined structure by performing the speech signal encoding process.

In other words, when the loss of the data occurs, the encoder fixedly sets the encoding process for speech signals, and encodes the sound signal into the independently decodable encoded signal. This simple control makes it possible to minimize the loss of the sound resulting from the loss of the data.

In addition, for example, when receiving the notification Indicating the loss of the data, the characteristic determining unit may be configured to cause the encoder to encode the portion of the sound signal to have the predetermined structure by performing the audio signal encoding process.

In other words, when the loss of the data occurs, the encoder fixedly sets the encoding process for audio signals, and encodes the sound signal into the independently decodable encoded signal. This simple control makes it possible to minimize the loss of the sound resulting from the loss of the data.

In addition, for example, when receiving the notification indicating the loss of the data, the characteristic determining unit may be configured to: cause the encoder to encode the portion to have the predetermined structure by performing the speech signal encoding process, when determining that the sound signal is the speech signal; and cause the encoder to encode the portion to have the predetermined structure by performing the audio signal encoding process, when determining that the sound signal is the audio signal.

In other words, when the loss of the data occurs, the encoder maintains the one of the encoding processes set by switching, and encodes the sound signal into the independently decodable encoded signal. In this way, it is possible to minimize the loss of the sound resulting from the loss of the data with the encoding efficiency maintained.

In addition, for example, the portion encoded to have the predetermined structure in the encoded signal may correspond to one or more frames, and all of the frames may be frames encoded according to Algebraic Code Excited Linear Prediction.

In addition, for example, the portion encoded to have the predetermined structure in the encoded signal may correspond to one or more frames, and all of the frames may be frames each having initialized context information.

In addition, for example, the packet loss detecting unit may be configured to: measure network delay amounts each indicating a time duration from the transmission of the encoded signal by the transmitting unit to the reception of the encoded signal by the receiving unit; calculate an average network delay amount from the network delay amounts within a predetermined time period; and when the average network delay amount is larger than a predetermined threshold value, transmit the notification indicating the loss of the data to the characteristic determining unit.

In other words, the loss of the data is detectable based on the network delay amount.

In addition, for example, the packet loss detecting unit may be configured to detect the loss of the data, based on a data number which is included in the encoded signal received by the receiving unit, and when a data loss occurrence rate within the predetermined time period is higher than the predetermined threshold value, transmit the notification indicating the loss of the data to the characteristic determining unit.

In other words, the loss of the data is detectable based on the data loss occurrence rate.

In addition, for example, in a packet loss period which is a period from the transmission of the notification indicating the loss of the data by the packet loss detecting unit to the reception by the receiving unit of the signal generated by encoding the portion to have the predetermined structure, the decoder may decode the portion which is independently decodable in the encoded signal received by the receiving unit in the packet loss period.

In this way, the decoder decodes the independently decodable portion, which makes it possible to prevent a full loss of the sound although sound quality as a whole decreases. In other words, this processing also makes it possible to minimize the loss of the sound resulting from the loss of the packet.

A decoding apparatus according to an aspect of the present invention is a decoding apparatus for use in any one of encoding and decoding systems in the above embodiments, and includes the receiving unit; the decoder; and the packet loss detecting unit.

An encoding apparatus according to an aspect of the present invention is an encoding apparatus for use in any one of encoding and decoding systems in the above embodiments, and includes the characteristic determining unit; the encoder; the transmitting unit; and the packet loss detecting unit.

An encoding and decoding method according to an aspect of the present invention is an encoding and decoding method for encoding a sound signal into an encoded signal, and decoding the encoded signal, the encoding and decoding method including: determining whether the sound signal is a speech signal or an audio signal, based on an audio characteristic of the sound signal; encoding the sound signal by performing a speech signal encoding process when the sound signal is determined to be the speech signal in the determining, and encoding the sound signal by performing an audio signal encoding process when the sound signal is determined to be the audio signal in the determining; transmitting the encoded signal; receiving the encoded signal transmitted in the transmitting; decoding the encoded signal received in the receiving; and detecting a loss of data of the encoded signal in the reception of the encoded signal in the receiving, wherein, when receiving the notification indicating the loss of the data, causing a portion of the sound signal to be encoded to have a predetermined structure, and the portion encoded to have the predetermined structure in the encoded signal corresponds to one or more frames, and all of the frames are independently decodable in the decoding.

Hereinafter, embodiments according to the present invention are described with reference to the drawings.

Each of the exemplary embodiments described below shows a general or specific example. The numerical values, shapes, materials, structural elements, the arrangement and connection of the structural elements, steps, the processing order of the steps etc. shown in the following exemplary embodiments are mere examples, and therefore do not limit the scope of the appended Claims and their equivalents. Therefore, among the structural elements in the following exemplary embodiments, structural elements not recited in any one of the independent claims are described as arbitrary structural elements.

In the embodiments below, an encoding and decoding system using the USAC is described as an example. However, the present invention is not limited to the encoding and decoding system using the USAC. The present invention is applicable to a case where an encoding method for encoding frames which are independently decodable and frames which are not independently decodable is used in a frame-based encoding and decoding system for speech signals and audio signals.

Embodiment 1

Hereinafter, Embodiment 1 according to the present invention is described.

First, a structure of an encoding and decoding system and operations performed thereby are described briefly below.

Figure 3:
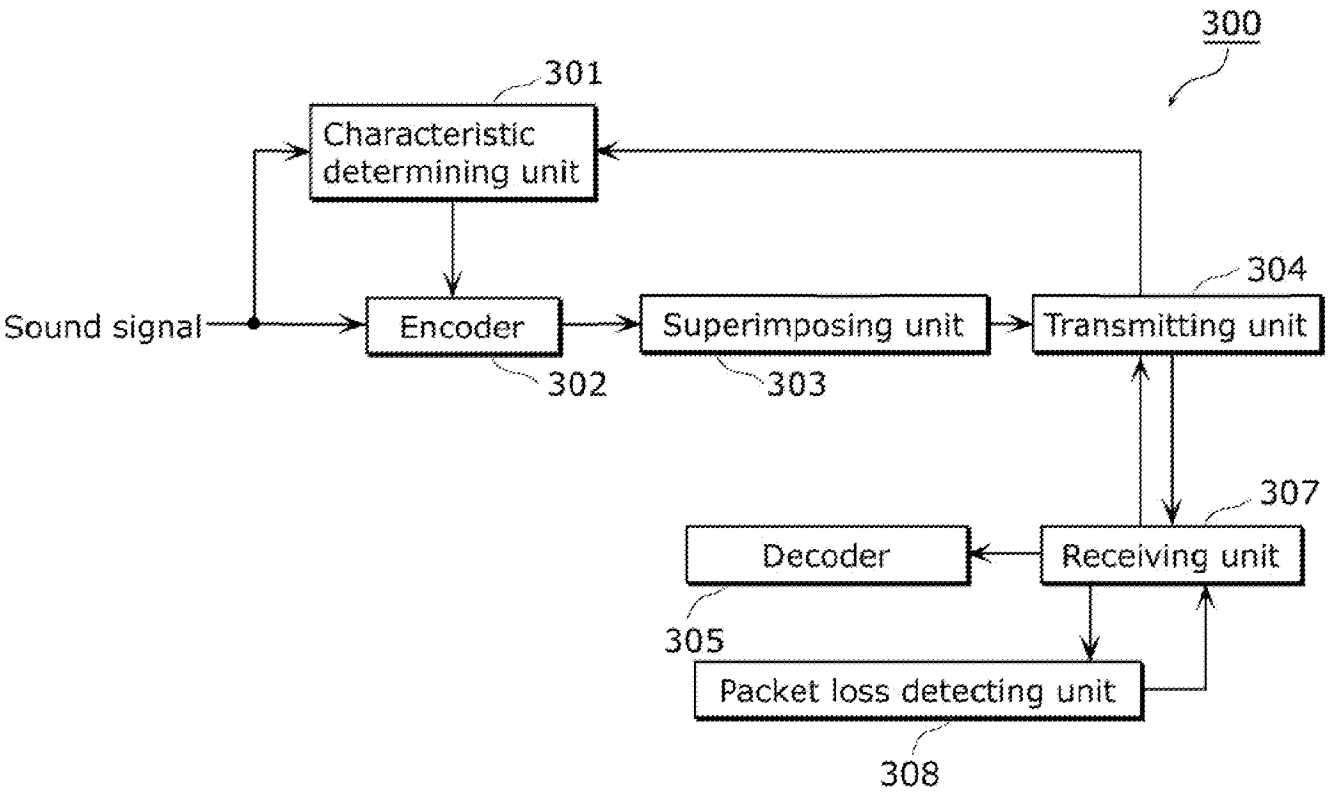
FIG. 3 is a block diagram showing a structure of an encoding and decoding system according to Embodiment 1.

FIG. 3 is a block diagram showing the structure of the encoding and decoding system according to Embodiment 1.

As shown in FIG. 3, the encoding and decoding system 300 includes: a characteristic determining unit 301, an encoder 302, a superimposing unit 303, a transmitting unit 304, a decoder 305, a receiving unit 307, and a packet loss detecting unit 308.

The characteristic determining unit 301 determines, for every predetermined number of samples (for each frame), whether or not a sound signal to be input to the encoding and decoding system 300 is a speech signal or an audio signal. Specifically, the characteristic determining unit 301 determines whether or not the unit of encoding is a speech signal or an audio signal, based on audio characteristics of the frame.

More specifically, first, the characteristic determining unit 301 calculates a spectrum strength in a frequency band above 3 kHz of the frame and a spectrum strength in a frequency band of 3 kHz or below of the frame. When the spectrum strength in the frequency band of 3 kHz or below is larger than the spectrum strength in the frequency band above 3 kHz, the characteristic determining unit 301 determines that the frame is a frame of a signal mainly including a speech signal, in short, a speech signal, and notifies the encoder 302 of the determination result. Likewise, when the spectrum strength in the frequency band of 3 kHz or below is smaller than the spectrum strength in the frequency band above 3 kHz, the characteristic determining unit 301 determines that the frame is a frame of a signal mainly including an audio signal, in short, an audio signal, and notifies the encoder 302 of the determination result.

In addition, when the characteristic determining unit 301 receives a notification indicating a packet loss from a later-described packet loss detecting unit 308, the characteristic determining unit 301 causes the encoder 302 to encode the audio signal into frames each decodable independently. This control is described in detail later.

When the characteristic determining unit 301 determines a current frame to be a frame mainly including a speech signal, the encoder 302 performs the encoding process for speech signals on the frame. The USAC involves the Linear Prediction Domain (LPD) encoding as the encoding process for speech signals. When the characteristic determining unit 301 determines a current frame to be a frame mainly including an audio signal, the encoder 302 performs the encoding process for audio signals on the frame. The USAC involves Frequency Domain (FD) encoding as the encoding process for audio signals.

The aforementioned operation by the encoder 302 is a normal USAC encoding process (hereinafter also referred to as a normal encoding mode). However, when the characteristic determining unit 301 receives the notification indicating the packet loss from the later-described packet loss detecting unit 308 as described above, the encoder 302 performs a special USAC process (hereinafter also referred to as a special encoding mode) for encoding the audio signal into frames each decodable independently. Details of the encoding method in the special encoding mode are described later.

The superimposing unit 303 synthesizes the frames encoded by the encoder 302 to generate a bitstream (an encoded signal). In this embodiment, the encoding and decoding system 300 additionally includes the superimposing unit 303, the one or more functions of the superimposing unit 303 may be realized as part of the functions of the encoder 302.

The transmitting unit 304 transmits the bitstream generated by the superimposing unit 303 in a format suitable for a transmission path. The transmission path is, for example, an IP network such as a mobile communication network (for 3G mobile terminals) and a fixed internet.

The receiving unit 307 receives the bitstream transmitted from the transmitting unit 304 through the transmission path. Depending on the transmission path, information other than the bitstream itself, for example, network control information for specifically controlling the transmission path may be communicated between the transmitting unit 304 and the receiving unit 307. The network control information is, for example, an encoding parameter such as a bit rate of the bitstream to be transmitted, the number of channels, an encoding scheme (USAC initial setting information (USACConfig( ) etc.) etc. in this embodiment), or information indicating the status of the transmission rate, such as a transmission error rate and a transmission delay amount.

The decoder 305 decodes the bitstream received by the receiving unit 307.

In this embodiment, the transmission path is an internet protocol (IP) network composed of internet protocols. In the IP network, the bitstream is basically transmitted in the form of IP packets. Conceivable factors for losses of frames in the IP network are a loss of an IP packet and a transmission error of an IP packet.

In the case of the transmission error of the IP packet, the transmission error is basically corrected using a data correction function provided in the IP network. In the case of the loss of the IP packet, the packet loss is basically compensated using a packet re-transmission function provided in the IP network.

Hereinafter, the packet re-transmission function is described.

The loss of the IP packet in the IP network is detectable by always monitoring the packet number assigned to the packet data of the IP packet.

Figure 4:
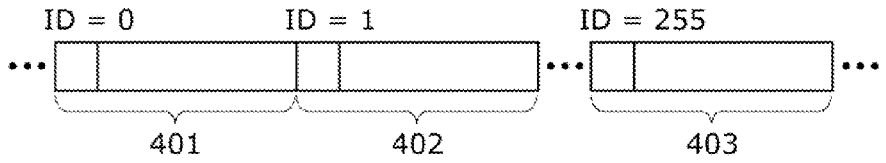
FIG. 4 is a schematic diagram showing a packet data according to the embodiment.

FIG. 4 is a schematic diagram showing the packet data.

The packet number is a periodic number. A packet is assigned with a packet number, and continuous packets are assigned with continuous packet numbers. In other words, the continuous packets are sequentially assigned with continuous packet numbers starting with 0. As shown in FIG. 4, the packet 401 is assigned with a packet number of 0, and the next packet 402 is assigned with a packet number of 1.

When the packet number reaches to the maximum number (for example, 255), the packet number returns back to 0. In other words, the packet number of the packet next to the packet 403 in FIG. 4 is 0.

The receiving unit 307 detects the packet number of each of packets upon receiving the packet, and temporarily stores it internally. Upon receiving the next packet, the receiving unit 307 compares the packet number of the currently-received packet with the temporarily stored packet number of the packet received immediately before. When the comparison shows that the difference between the packet numbers is 1 or the predetermined maximum number (for example, 255), the receiving unit 307 determines that no packet loss occurred. When the comparison shows that the difference between the packet numbers is neither 1 nor the predetermined maximum number (for example, 255), the receiving unit 307 determines that a packet loss occurred, and requests the transmitting unit 304 side to re-transmit the packet with the missing packet number.

As described above, even in the cases of the IP packet loss or the IP packet transmission error, a right packet is basically compensated by the function of the IP network. However, in an exemplary case where a bad communication status continues over a long period, lost or error packets may not be fully compensated by the functions of the IP network.

In view of this, the encoding and decoding system 300 includes the packet loss detecting unit 308 which detects such packet losses in the IP network. The packet loss detecting unit 308 is a unique structural element of the encoding and decoding system 300.

The packet loss detecting unit 308 sequentially stores the number of re-transmissions of IP packets and the number of compensations (the number of packet loss information items) both detected by the receiving unit 307, and calculates determination information for switching encoding modes (the normal encoding mode and the special encoding mode described above). The determination information is transmitted to the transmitting unit 304 side as part of the network control information communicated between the receiving unit 307 and the transmitting unit 304.

The transmitting unit 304 transmits the received determination information to the characteristic determining unit 301. Based on the determination information, the characteristic determining unit 301 causes the encoder 302 to perform one of the encoding process according to the normal encoding mode and the encoding process according to the special encoding mode.

Hereinafter, descriptions are given of details of operations performed by the encoding and decoding system 300.

First, a method performed by the packet loss detecting unit 308 to calculate determination information is described together with a specific structure of the packet loss detecting unit 308.

Figure 5:
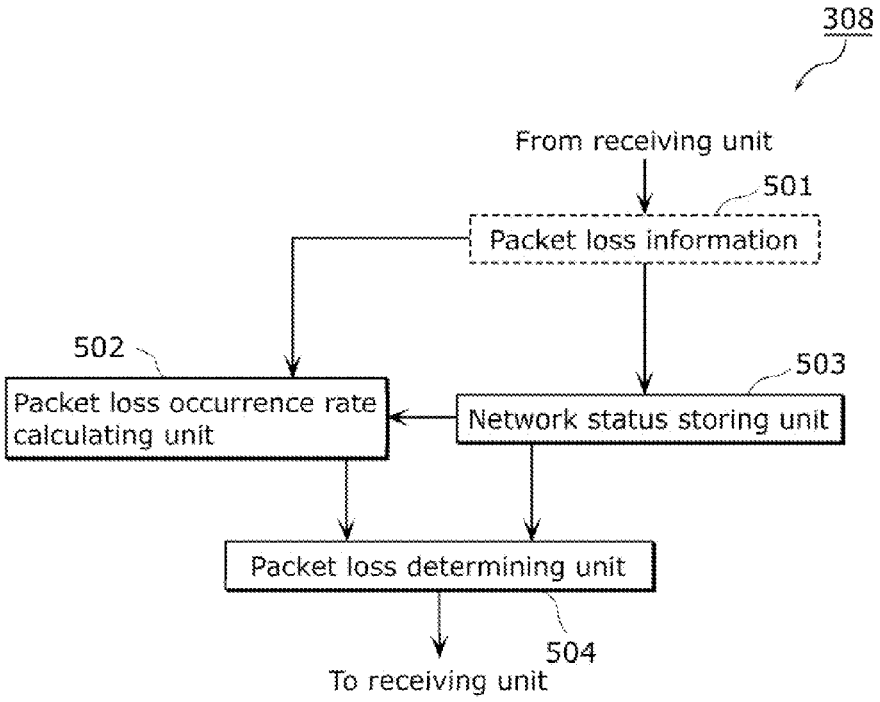
FIG. 5 is a block diagram showing a specific structure of a packet loss detecting unit according to Embodiment 1.

FIG. 5 is a block diagram showing the specific structure of the packet loss detecting unit 308.

Figure 6:
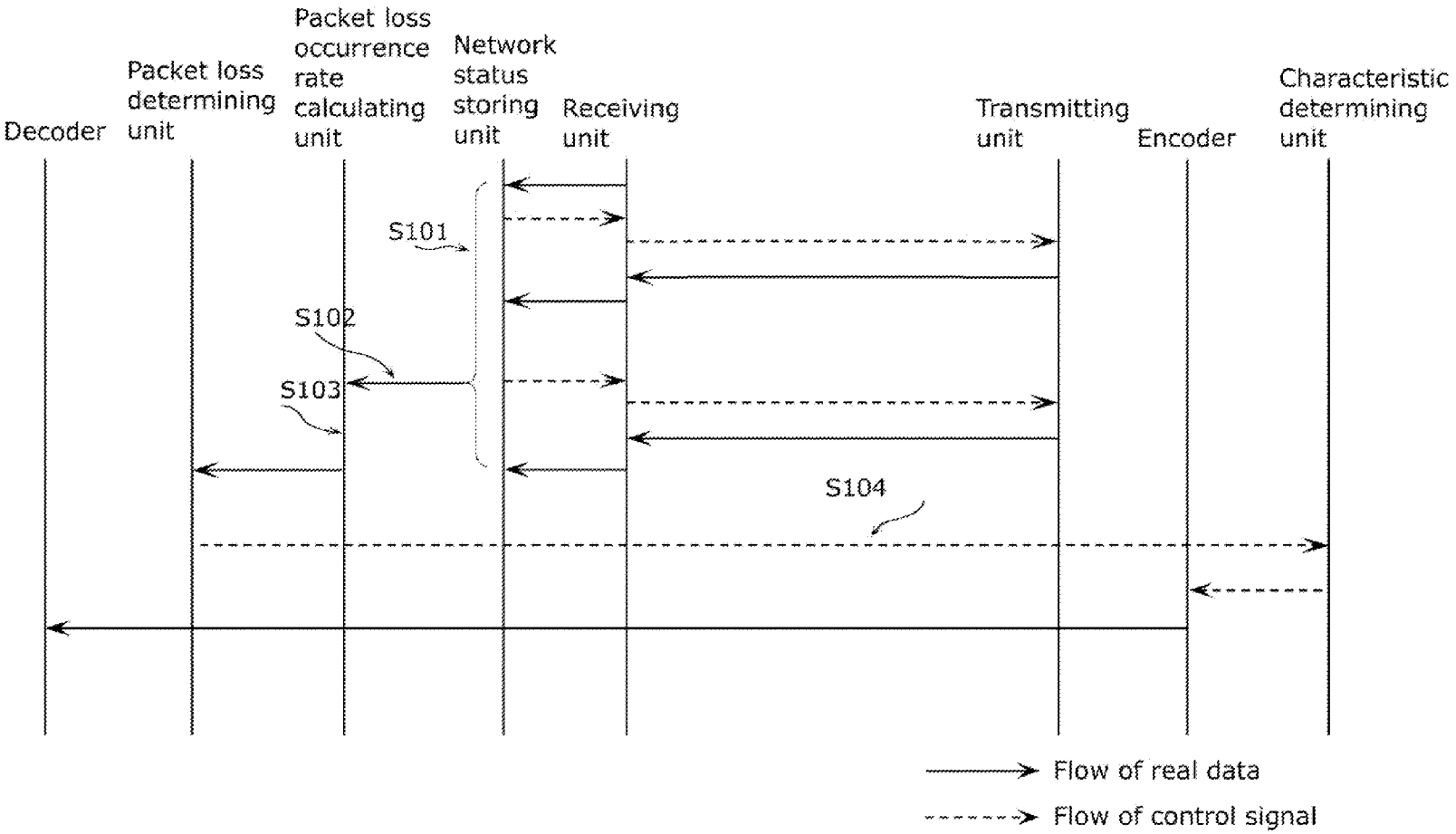
FIG. 6 is a diagram showing a flow of control in the encoding and decoding system according to Embodiment 1.

FIG. 6 is a diagram showing a flow of control in an encoding and decoding system according to Embodiment 1.

Figure 7:
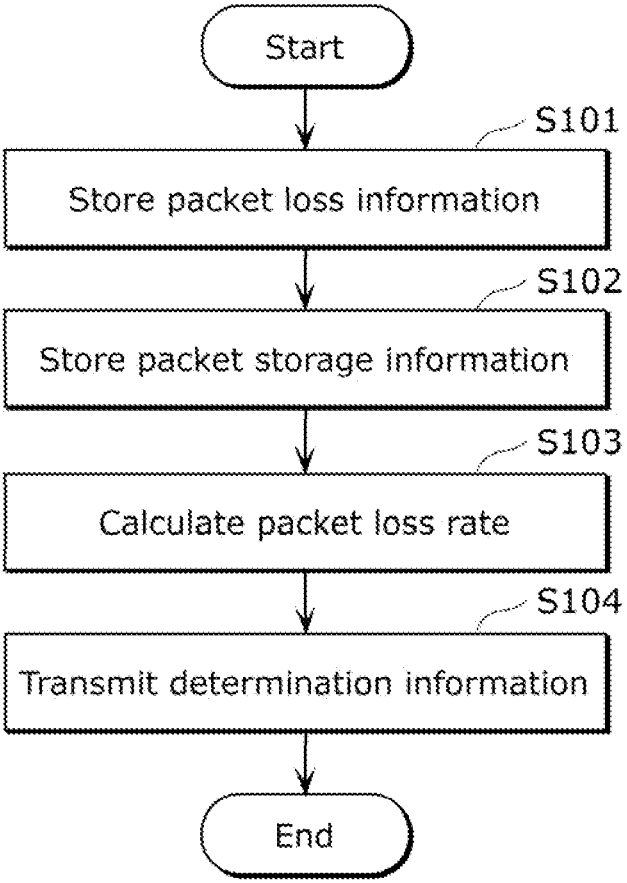
FIG. 7 is a flowchart of a method of calculating determination information provided by the packet loss detecting unit according to Embodiment 1.

FIG. 7 is a flowchart of a method of calculating determination information provided by the packet loss detecting unit 308.

As shown in FIG. 5, the packet loss detecting unit 308 includes a packet loss occurrence rate calculating unit 502, a network status storing unit 503, and a packet loss determining unit 504.

The network status storing unit 503 sequentially stores packet loss information items 501 (the number of re-transmissions of IP packets and the number of compensations of IP packets) received and detected by the receiving unit 307 through the network (S101 of FIG. 6 and FIG. 7). More specifically, the network status storing unit 503 stores the number of re-transmissions of IP packets, the number of compensations of IP packets, and the total number of packets (the number of packet storage information items) all of which occurred in a storage period (for example, 1 second) predetermined for each of services (S102 In FIG. 6 and FIG. 7). Next, the network status storing unit 503 transmits, for each storage period, the packet storage information to the packet loss occurrence rate calculating unit 502.

The packet loss occurrence rate calculating unit 502 calculates a packet loss rate according to Expression (1) based on the packet storage information for each storage period (S103 in FIG. 6 and FIG. 7).

(The number of re-transmissions of IP packets+
the number of compensations of IP packets)/
the total number of packets*2 Expression (1)

When the packet loss rate according to Expression (1) exceeds or equals to a predetermined threshold value, the packet loss determining unit 504 sets the determination information to the special encoding mode, and transmits the determination information to the transmitting unit 304 side (the characteristic determining unit 301). When the packet loss rate according to Expression (1) is smaller than the predetermined threshold value, the packet loss determining unit 504 sets the determination information to the normal encoding mode, and transmits the determination information to the characteristic determining unit 301 (S104 in FIG. 6 and FIG. 7). The predetermined threshold value differs among applications using the USAC. For example, the predetermined threshold value is 20% in the case of transmission using the USAC in a 3G mobile communication technique. This predetermined threshold value is a mere non-limiting example.

Next, encoding performed by the encoder 302 is described in detail.

Figure 8:
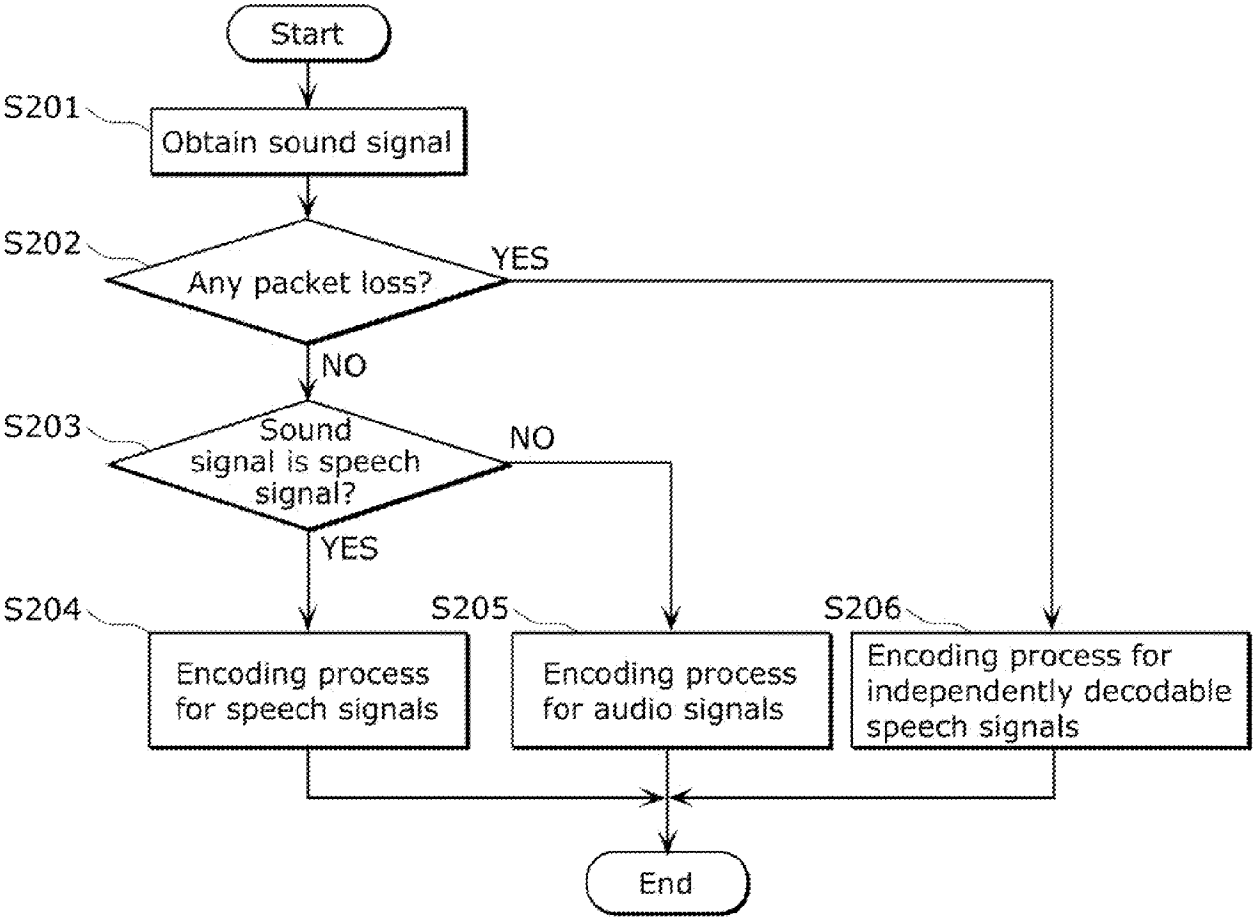
FIG. 8 is a flowchart of encoding performed by the encoder according to Embodiment 1.

FIG. 8 is a flowchart of the encoding performed by the encoder 302.

Figure 9:
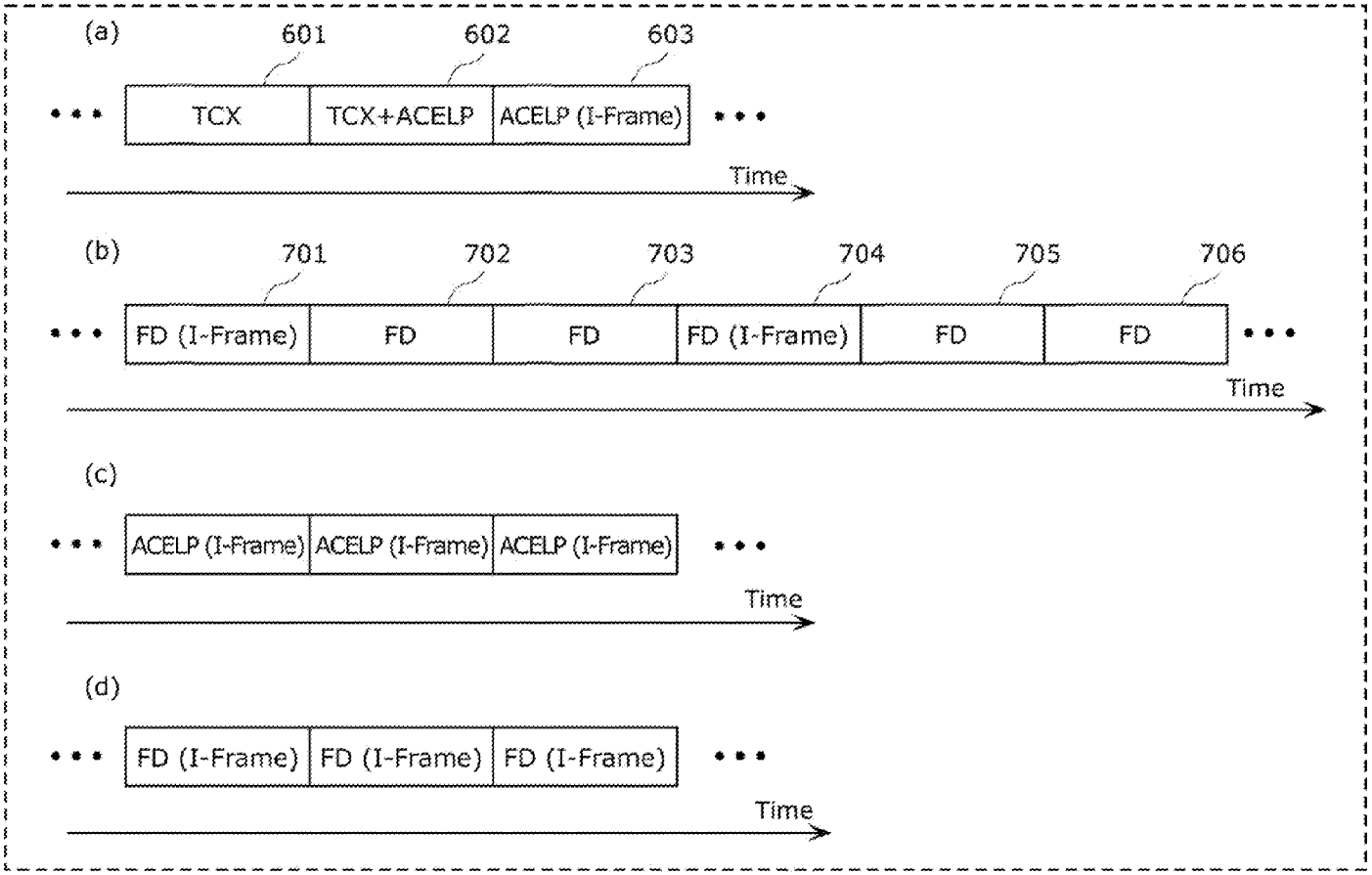
FIG. 9 shows schematic diagrams for explaining encoding performed by the encoder according to Embodiment 1.

FIG. 9 shows schematic diagrams for explaining the encoding performed by the encoder 302.

When the encoder 302 obtains a sound signal (S201 in FIG. 8) and encodes the sound signal, and when the characteristic determining unit 301 does not receive any notification indicating a packet loss (No in S202 of FIG. 8), the encoder 302 performs encoding according to the normal encoding mode. More specifically, when the characteristic determining unit 301 determines that a current sound signal is a speech signal (Yes in S203 of FIG. 8), the encoder 302 performs an LPD encoding process on the sound signal (S204 in FIG. 8).

In this embodiment, the LPD encoding processes are the Transform Coded Excitation (TCX) and the algebraic Code Excited Liner Prediction (ACELP). When performing one of the LPD encoding processes, the encoder 302 encodes the sound signal into frames of TCX_Code( ) or ACELP_Code( ) in FIG. 1.

The TCX is an encoding scheme used to encode a wideband speech signal having a frequency band of 50 Hz to 7000 Hz.

The ACELP is a kind of the Code Excited Liner Prediction (CELP). The ACELP is for efficiently encoding periodic signals such as human voice using a stored codebook having an algebraic format.

Accordingly, in the LPD encoding processes, three kinds of encoded frames are generated.

A frame of a first kind is a frame encoded entirely according to the TCX, for example, a frame 601 shown in (a) of FIG. 9. A frame of a second kind is a frame having a portion encoded according to the TCX and a portion encoded according to the ACELP, for example, a frame 602 shown in (a) of FIG. 9. A frame of a third kind is a frame encoded entirely according to the ACELP, for example, a frame 603 shown in (a) of FIG. 9.

Frames encoded according to the TCX are classified into a frame which is not independently decodable and a frame which is Independently decodable. In other words, frames whose FlagIndependency information shows "decodable" includes a frame encoded according to the TCX. The frame 603 encoded entirely according to the ACELP is an independently decodable frame.

In the opposite case where the characteristic determining unit 301 determines that a current sound signal is an audio signal (No in S203 of FIG. 8), the encoder 302 performs an FD encoding process on the sound signal (S205 in FIG. 8).

In Embodiment 1, the FD encoding process is, for example, an encoding process for increasing encoding efficiency by performing spectrum quantization conforming to the AAC using arithmetic codes instead of Huffman codes.

In this case, the encoder 302 encodes the sound signal into frames of FD_Channel_Element( ) (Arith_Code( )) in FIG. 1.

Here, as shown in (b) of FIG. 9, the frame 701 is a frame (I-Frame) which is independently decodable whereas the frame 702 is a frame of arithmetic codes which is decoded using context information of the frame 701. For this reason, the frame 702 cannot be decoded until the frame 701 is decoded. Likewise, the frame 703 is a frame decoded using the context information of the frame 702, and thus cannot be decoded until the frame 702 is decoded. In other words, the frames 702 and 703 are independently decodable frames.

Here, after a predetermined period elapses from the encoding of the frame 701, the context information is initialized. In other words, the frame 704 is a frame encoded as an independently decodable frame. The next frame 705 cannot be decoded until the frame 704 is decoded, and the frame 706 cannot be decoded until the frame 705 is decoded. The same applies to the following frames.

The predetermined period is a period which is arbitrarily set depending on an application to be used for encoding.

When the characteristic determining unit 301 receives the notification indicating the packet loss (Yes in S202 of FIG. 8), the encoder 302 encodes unencoded portion of the sound signal to have a predetermined structure. In other words, the encoder 302 performs encoding according to the special encoding mode. In Embodiment 1, more specifically, the encoder 302 performs encoding using the fixed encoding mode involving only the ACELP among encoding processes for speech signals, as shown in (c) of FIG. 9 (S206 in FIG. 8).

While the characteristic determining unit 301 receives the notification indicating the packet loss and the encoder 302 performs encoding according to the fixed encoding mode, the characteristic determining unit 301 observes temporal change in the determination information, and causes the encoder 302 to perform encoding according to the fixed encoding mode until a normal status continues for a duration after a return from a packet loss.

After the duration, the characteristic determining unit 301 causes the encoder 302 to perform encoding according to the normal encoding mode. For example, when determination information items set to the normal encoding mode had been received sequentially, for example, over 10 seconds or longer, the characteristic determining unit 301 determines the return to be successful. This time period is a mere non-limiting example. This time is variable depending on transmission characteristics (such as a delay, a packet loss rate, a communication speed, etc.) of the communication network.

Substantially all frames encoded by the encoder 302 according to the fixed encoding mode are independently decodable frames denoted as (I-Frame). Here, supposing that FlagIndependency in a frame shown in FIG. 1 denotes "Independently undecodable", the frame encoded only using the ACELP can be forcibly subject to ACELP decoding at the decoder 305 side. In other words, the encoding and decoding system 300 is capable of decoding a data part encoded according to the ACELP in a frame denoted as "Undecodable" immediately after the return from the packet loss.

Figure 10:
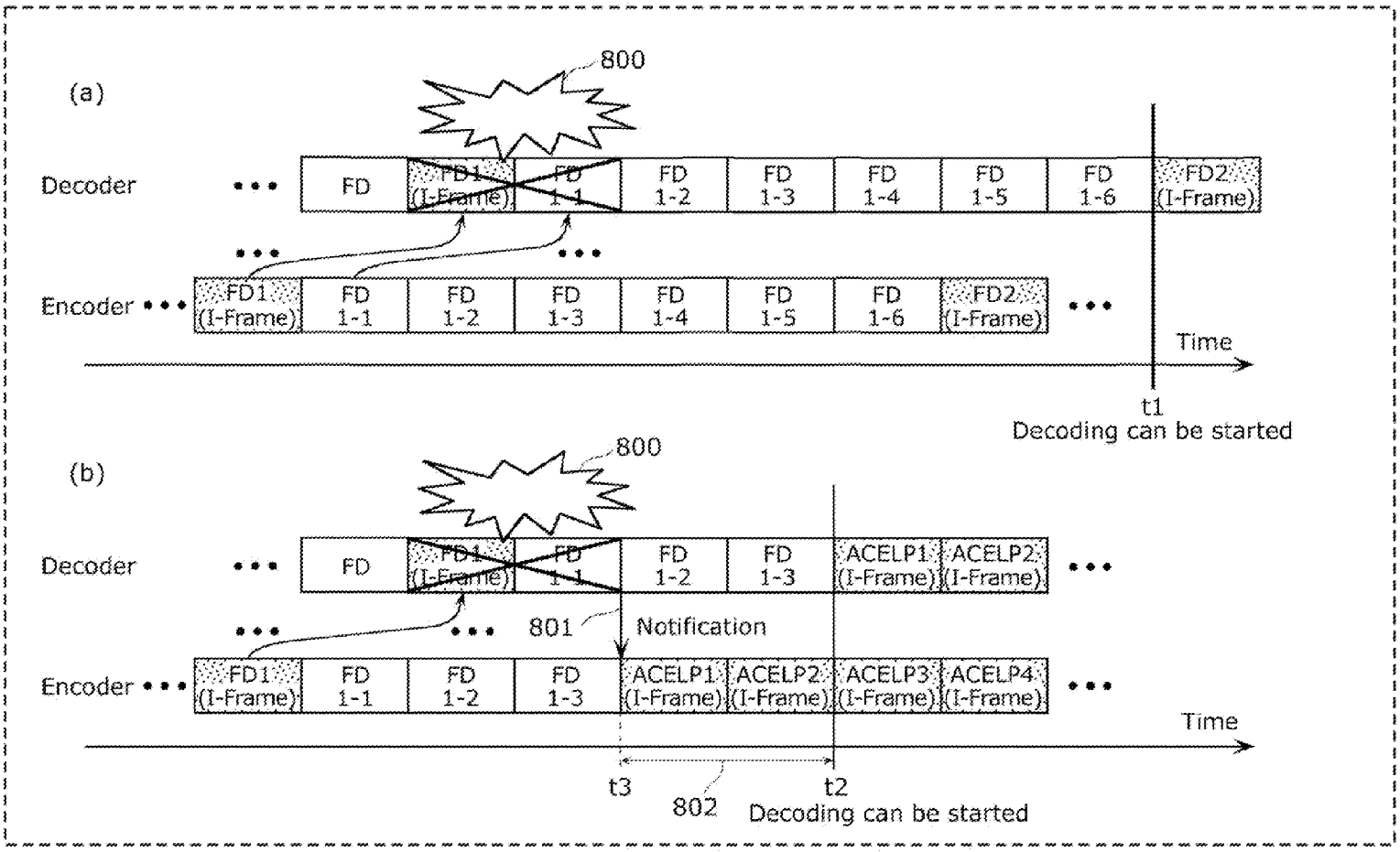
FIG. 10 shows schematic diagrams showing decoding performed in the encoding and decoding system after an occurrence of a packet loss.

FIG. 10 shows schematic diagrams showing decoding performed in the encoding and decoding system 300 after an occurrence of a packet loss. FIG. 10 schematically shows encoded signals to be transmitted, and each of rectangles therein shows a frame. FIG. 10 schematically shows a case where a packet loss 800 occurred in an FD encoding process by the encoder 302, and a frame assigned with the characters common between the encoder 302 and the decoder 305 is the same frame. The frames each denoted as (I-Frame) therein are independently decodable frames.

As shown in (a) of FIG. 10, when the packet loss 800 occurred in an encoding and decoding system which does not apply the present invention, a decoder 305 cannot re-start decoding until it receives a next independently decodable frame at a timing t1.

In contrast, as shown in (b) of FIG. 10, when the packet loss 800 occurred in the encoding and decoding system 300, the packet loss detecting unit 308 transmits a notification 801 (of determination information) indicating the packet loss to the characteristic determining unit 301. After the characteristic determining unit 301 receives the notification 801, the encoder 302 performs encoding according to the fixed encoding mode.

Accordingly, in the signal portion (generated by encoding the unencoded portion of the sound signal to have the predetermined structure) of the encoded signal, all of frames encoded by the encoder 302 after a timing t3 are frames independently decodable by the decoder 305. In other words, the decoder 305 can start decoding at the timing t2 before the timing t1.

As described above, the encoding and decoding system 300 according to Embodiment 1 also makes it possible to minimize time during which decoding cannot be performed after the occurrence of the packet loss, to thereby minimize a sound loss resulting from the packet loss.

In Step S206, the encoder 302 may perform encoding according to a variable length encoding mode for encoding a sound signal into an encoded signal composed only of frames having initialized context information, as shown in (d) of FIG. 9.

As described above, the frames having the initialized context information can be decoded independently without using information of a previous frame. Accordingly, similarly in the case of the fixed encoding mode according to the ACELP, the variable length encoding mode as described in Step S206 also minimizes a time duration in which decoding cannot be performed, between the occurrence of the packet loss and the return. In other words, the decoder 305 can perform decoding starting with a frame immediately after the return from the packet loss, to thereby minimize a sound loss resulting from the packet loss.

In a packet loss period 802 shown in (b) of FIG. 10, the decoder 305 may decode some of independently decodable portions among the portions of the encoded signal received by the receiving unit in a packet loss period 802. The packet loss period 802 is a period from when the packet loss detecting unit 308 transmitted the notification indicating the packet loss (a timing t3) to when the receiving unit 307 received the signal encoded using an independently decodable frame (the signal was encoded to have the predetermined structure) (a timing t2).

In (b) of FIG. 10, the frames received by the receiving unit 307 in the packet loss period 802 are frames which were encoded through the FD encoding process and cannot be decoded independently, and thus cannot be decoded by the decoder 305. However, when a frame received by the receiving unit 307 in the packet loss period 802 is a frame such as the frame 602 shown in (a) of FIG. 9, the decoder 305 can decode a part thereof which is independently decodable according to the method below.

The frame 602 is a frame having a portion encoded according to the TCX and a portion encoded according to the ACELP. In the TCX and the ACELP, Linear prediction coefficients (LPC coefficients) are used for efficiently encoding speech signals. Thus, linear prediction coefficients are always included irrespective of which one of the schemes is used. Such linear prediction coefficients are coefficients which can be converted into a spectrum envelope of a speech signal. Thus, the sound signal can be decoded adequately when the spectrum envelop can be reproduced to some extent. The frame including the portion encoded according to the ACELP includes at least one liner prediction coefficient. In respect of the characteristics of the speech signal, there is a high possibility that the liner prediction coefficient does not change significantly in a frame time of approximately several tens of milliseconds.

Accordingly, the decoder 305 can forcibly decode the portion encoded according to the ACELP in the encoded signal, and the remaining portion encoded according to the TCX can be pseudo-decoded by re-using the linear prediction coefficient obtained in a process of the ACELP decoding. In this case, a sound quality as a whole decreases below the one obtainable in the case where the portions encoded according to the TCX and ACELP are completely decoded to precisely reconstruct the original encoded signal, but the characteristic component of the speech signal can be reproduced because it is the at least one linear prediction coefficient that greatly contributes to characterization of the speech signal.

In this way, the decoder 305 decodes the frames which can be independently decodable in the packet loss period 802, which makes it possible to prevent a full loss of the sound although sound quality as a whole decreases. In other words, this also makes it possible to minimize the sound loss resulting from the packet loss.

Embodiment 2

Hereinafter, Embodiment 2 according to the present invention is described.

Embodiment 1 describes an exemplary case where the packet loss detecting unit 308 detects a loss of packet data based on the number of re-transmissions of IP packets and the number of compensations of IP packets (in other words, transmits the determination information items). However, the method of detecting a packet data loss is not limited thereto. Embodiment 2 describes a case where the packet loss detecting unit 308 detects a packet data loss based on a network delay amount.

In Embodiment 1, when the characteristic determining unit 301 receives the notification indicating the packet loss, the encoder 302 performs one of the encoding process for speech signals and the encoding process for audio signals until a return from a packet loss status is made and a normal status continues for a duration. On the other hand, Embodiment 2 is characterized in that, when the characteristic determining unit 301 receives the notification indicating the packet loss, the encoder 302 performs encoding fixedly according to a selected one of the encoding process for speech signals unique to the USAC and the encoding process for audio signals.

First, a structure of an encoding and decoding system according to Embodiment 2 and operations performed thereby are described briefly below. An entire system structure of the encoding and decoding system according to Embodiment 2 is similar to the one shown in FIG. 3, and mainly differs in the structure of the packet loss detecting unit 308. In Embodiment 2, substantially the same structural elements as in Embodiment 1 are not described again.

Figure 11:
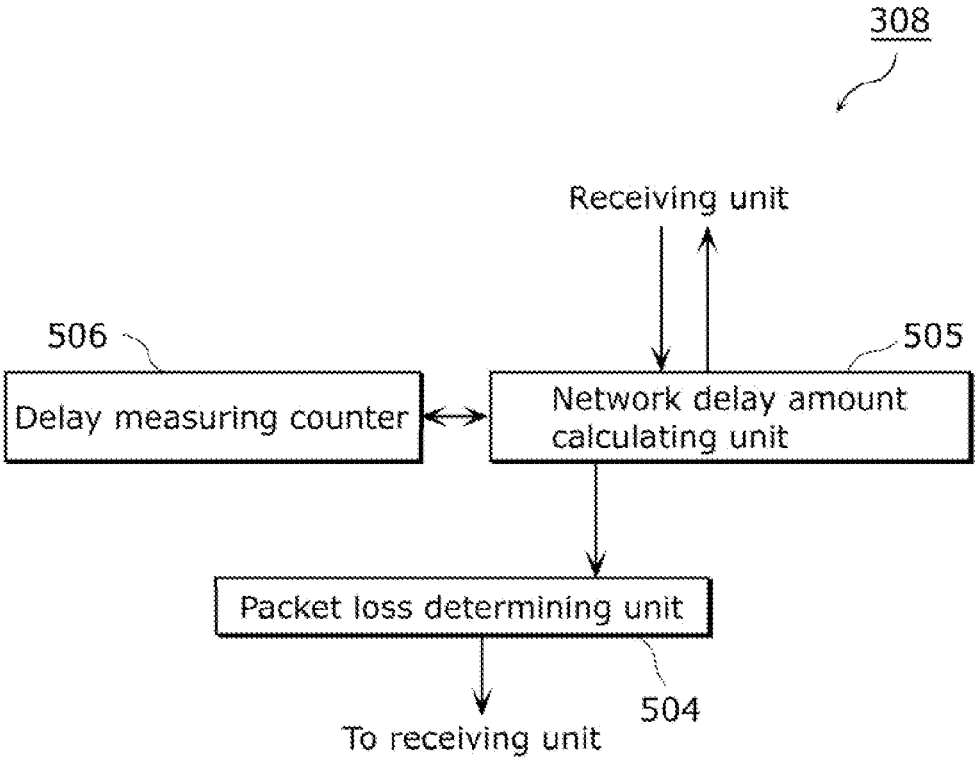
FIG. 11 is a block diagram showing a specific structure of a packet loss detecting unit according to Embodiment 2.

FIG. 11 is a block diagram showing a specific structure of a packet loss detecting unit according to Embodiment 2.

Figure 12:
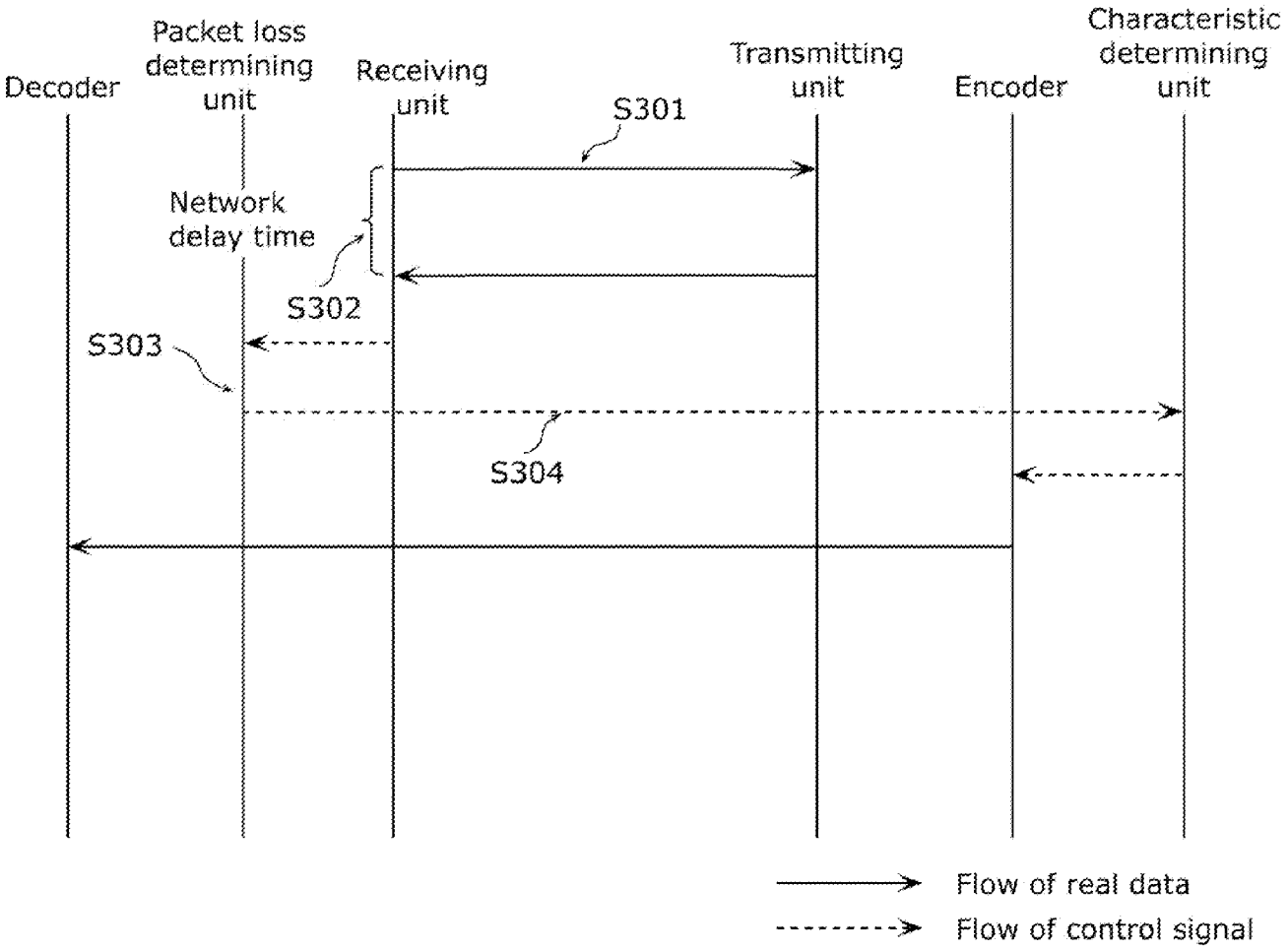
FIG. 12 is a diagram showing a flow of control in an encoding and decoding system according to Embodiment 2.

FIG. 12 is a diagram showing a flow of control in an encoding and decoding system according to Embodiment 2.

Figure 13:
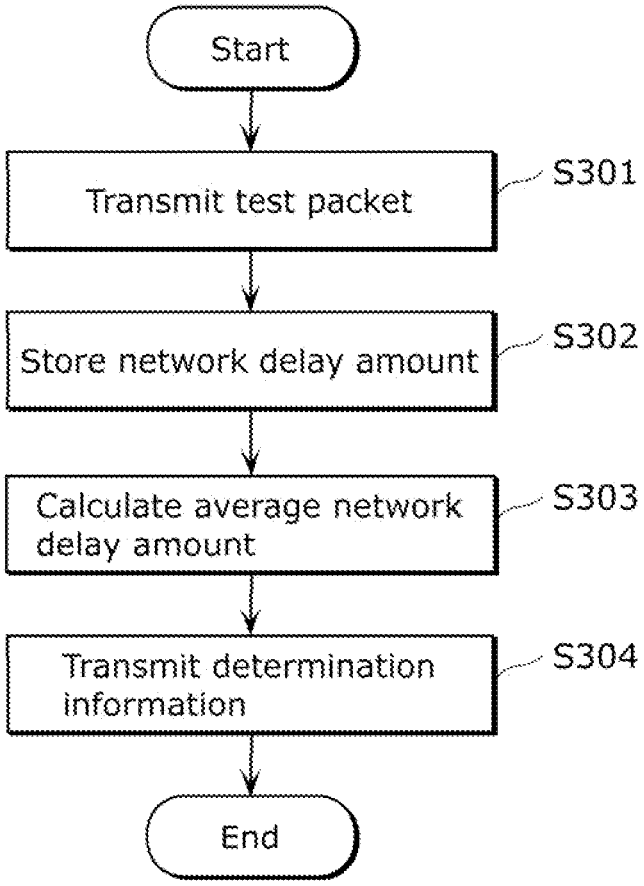
FIG. 13 is a flowchart of a method of calculating determination information provided by the packet loss detecting unit according to Embodiment 2.

FIG. 13 is a flowchart of a method of calculating determination information provided by the packet loss detecting unit according to Embodiment 2.

The packet loss detecting unit 308 according to Embodiment 2 includes a packet loss determining unit 504, a network delay amount calculating unit 505, and a delay measuring counter 506.

The packet loss detecting unit 308 according to Embodiment 2 always monitors a network delay amount between the transmitting unit 304 and the receiving unit 307.

More specifically, as shown in FIG. 11, the network delay amount calculating unit 505 transmits a test packet to the transmitting unit 304 side each time a predetermined time elapses (periodically) through the receiving unit 307, and receives a response to this (S301 in FIGS. 12 and 13). The predetermined time is, for example, 5 seconds. The test packet is, for example, a ping instruction which is normally used to determine whether a communication destination is operating through an IP network.

The network delay amount calculating unit 505 transmits the test packet and receives a response from the communication destination (in this case, the transmitting unit side), thereby being able to measure a network delay amount. More specifically, the network delay amount calculating unit 505 stores a time point at which the test packet was transmitted, and stores, as the network delay amount, a difference between the time at which the response was received from the communication destination and the time point at which the test packet was transmitted (S302 in FIG. 12 and FIG. 13). The ping instruction is described as a non-limiting example of the test packet, and thus any other form for measuring a network delay amount is possible.

Based on the network delay amount calculated in this way, the network delay amount calculating unit 505 calculates an average value of network delay amounts in a predetermined unit of time (for example, 1 minute), and determines the average value as an average network delay amount (S303 in FIG. 12 and FIG. 13).

When the network delay amount exceeds the average network delay amount, the network delay amount calculating unit 505 increments a count value of the delay measuring counter 506. When the network delay amount falls below the average network delay amount, the network delay amount calculating unit 505 decrements a count value of the delay measuring counter 506. In this way, the network delay amount calculating unit 505 increments or decrements the count value of the delay measuring counter 506 for each predetermined unit of time.

When the count value of the delay measuring counter 506 exceeds a threshold value (for example, 0), the packet loss determining unit 504 sets the determination information to a special encoding mode, and transmits the determination information to the transmitting unit 304 side (the characteristic determining unit 301) (S304 in FIG. 12 and FIG. 13). This is necessary because a count value of the delay measuring counter 506 increases showing that the network delay amount is on the increase, and that there is a high possibility of a packet loss.

In the opposite case where a count value of the delay measuring counter 506 decreases showing that the network delay amount is on the decrease, the packet loss determining unit 504 sets the determination information to a normal encoding mode, and transmits the determination Information to the transmitting unit 304 side (S304 in FIG. 12 and FIG. 13). Here, the threshold value of the delay measuring counter 506 may be arbitrarily set according to characteristics of an application, a network, etc. to be applied in the encoding and decoding.

Next, encoding by the encoder 302 according to Embodiment 2 is described in detail.

Figure 14:
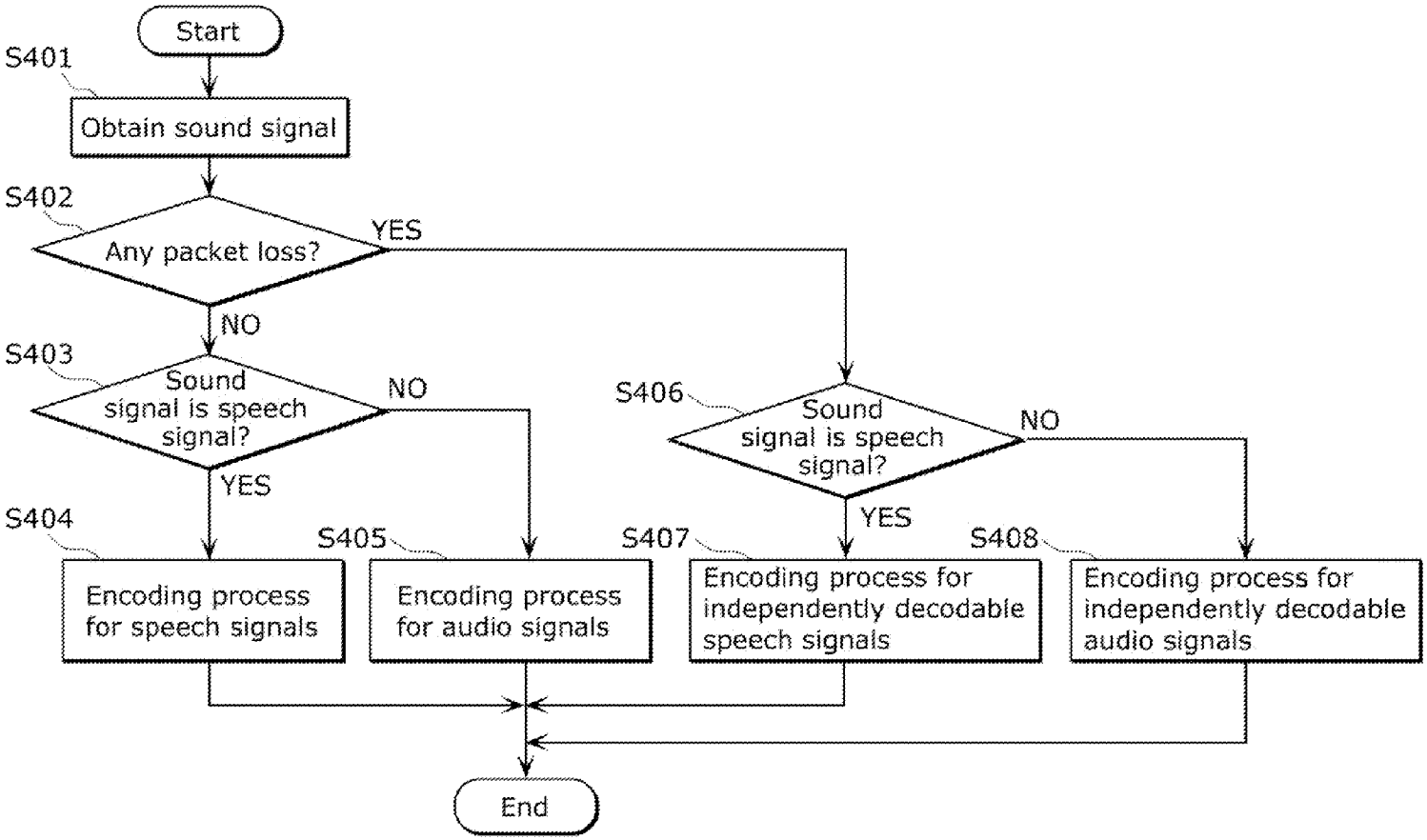
FIG. 14 is a flowchart of encoding performed by an encoder according to Embodiment 2.

FIG. 14 is a flowchart of encoding by the encoder 302.

Figure 15:
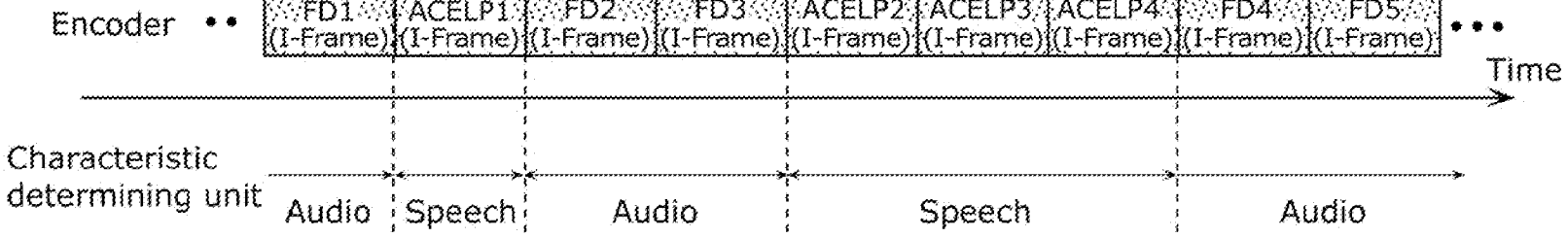
FIG. 15 shows a schematic diagram for explaining encoding performed by the encoder according to Embodiment 2.

FIG. 15 shows a schematic diagram for explaining encoding performed by the encoder according to Embodiment 302.

When the encoder 302 obtains a sound signal (S401 In FIG. 14) and encodes the sound signal, and when the characteristic determining unit 301 does not receive a notification indicating a packet loss (No in FIG. 14), the encoder 302 performs encoding according to the normal encoding mode. More specifically, when the characteristic determining unit 301 determines that a current sound signal is a speech signal (Yes in S403 of FIG. 14), the encoder 302 performs an LPD encoding process on the sound signal. In the opposite case where the characteristic determining unit 301 determines that a current sound signal is an audio signal (No in S403 of FIG. 14), the encoder 302 performs an FD encoding process on the sound signal. These encoding processes performed by the encoder 302 according to the normal encoding mode are the same as those according to the normal encoding mode described in Embodiment 1.

When the characteristic determining unit 301 receives a notification notifying a packet loss (Yes in S402 of FIG. 14), the encoder 302 performs encoding according to the special encoding mode. In Embodiment 2, the encoder 302 maintains a selected one of the speech signal encoding process and the audio signal encoding process also in the special encoding mode, and encodes the sound signal into an encoded signal composed of frames decodable independently.

More specifically, when the characteristic determining unit 301 determines that the current sound signal is a speech signal (Yes in S406 of FIG. 14), the encoder 302 performs encoding using only the ACELP among the encoding processes for speech signals (S407 in FIG. 14). When the characteristic determining unit 301 determines that the current sound signal is a speech signal (No in S406 of FIG. 14), the encoder 302 encodes the sound signal into an encoded signal composed only of frames having initialized context information, using the encoding process for audio signals (S408 in FIG. 14).

As a result, the signal encoded according to the special encoding mode in Embodiment 2 is the encoded signal composed of the frames as shown in FIG. 15 according to the determination made by the characteristic determining unit 301. In other words, substantially all of the frames of the encoded signal are independently decodable frames (I-Frames).

When the characteristic determining unit 301 receives a notification indicating an occurrence of a packet loss, and a return from the packet loss is successfully made, the characteristic determining unit 301 causes the encoder 302 to perform encoding using the normal encoding mode, based on the notification from the packet loss detecting unit 308.

As described above, the encoding and decoding system according to Embodiment 2 also makes it possible to minimize time during which decoding cannot be performed after the return from the packet loss, to thereby minimize a sound loss resulting from a packet loss.

When receiving the notification indicating the packet loss, the encoding and decoding system 300 according to Embodiment 1 does not determine whether a current sound signal is a speech signal or an audio signal. For this reason, the encoding and decoding system according to Embodiment 1 is characterized in performing simple control on the encoder 302 when receiving the notification indicating the packet loss. On the other hand, the encoding and decoding system according to Embodiment 2 is characterized in performing encoding efficiently even when receiving the notification indicating the packet loss.

[Variations]

The present invention is not limited to the above-described non-limiting embodiments.

The encoding and decoding system according to the present invention can be realized as a combination of an encoding apparatus and a decoding apparatus. For example, the encoding and decoding system may be configured to include: an encoding apparatus including a characteristic determining unit 301, an encoder 302 (a superimposing unit 303), a transmitting unit 304, and a packet loss detecting unit 308; and a decoding apparatus including a decoder 305 and a receiving unit 307.

For example, the encoding and decoding system may be configured to include: an encoding apparatus including a characteristic determining unit 301, an encoder 302 (a superimposing unit 303), and a transmitting unit 304; and a decoding apparatus including a decoder 305, a receiving unit 307, and a packet loss detecting unit 308. In this case, the packet loss detecting unit 308 can detect a packet loss using a network delay amount as described in Embodiment 2.

In addition, for example, the encoding and decoding system may include: an encoding apparatus including a characteristic determining unit 301, an encoder 302 (a superimposing unit 303), and a transmitting unit 304; a decoding apparatus including a decoder 305, and a receiving unit 307; and a network managing apparatus including a packet loss detecting unit 308.

Although the ACELP is used in the encoding process for speech signals in the above embodiments, the present invention is not limited thereto. For example, one of the CELP based on encoding principal such as the Vector Sum Excited Liner Prediction (VSELP) may be used in the encoding process for speech signals, as long as the process is for encoding each frame in an independently decodable manner.

Furthermore, the following implementations also include within the scope of the present invention.

(1) The encoding and decoding system is, specifically, a computer system including a microprocessor, a ROM, a RAM, a hard disk unit, a display unit, a keyboard, a mouse, and so on. A computer program is stored in the RAM or the hard disk unit. The respective apparatuses achieve their functions through the microprocessor's operations according to the computer program. Here, the computer program is configured by combining plural instruction codes indicating instructions for the computer, for exertion of predetermined functions.

(4) A part or all of the structural elements of the encoding and decoding system may be configured with a single system-LSI (Large-Scale Integration). The system-LSI is a super-multi-function LSI manufactured by integrating structural units on a single chip, and is specifically a computer system configured to include a microprocessor, a ROM, a RAM, and so on. A computer program is stored in the RAM. The system-LSI achieves its function through the microprocessor's operations according to the computer program.

(3) A part or all of the structural elements of the encoding and decoding system may be configured with an IC card which can be attached to and detached from the encoding and decoding system or as a stand-alone module. The IC card or the module is a computer system configured from a microprocessor, a ROM, a RAM, and so on. The IC card or the module may also be included in the aforementioned super-multi-function LSI. The IC card or the module achieves its functions through the microprocessor's operations according to the computer program. The IC card or the module may also be implemented to be tamper-resistant.

(4) The present invention may be implemented as the encoding and decoding methods described in the above embodiments. In addition, each of these methods may also be implemented as computer programs or digital signals representing the computer programs.

Furthermore, the present invention may also be implemented as computer programs or digital signals recorded on computer-readable recording media such as a flexible disc, a hard disk, a CD-ROM, an MO, a DVD, a DVD-ROM, a DVD-RAM, a BD (Blu-ray Disc (registered trademark)), and a semiconductor memory. Furthermore, the present invention may also be implemented as the digital signals recorded on these recording media.

Furthermore, the present invention may also be implemented as the aforementioned computer programs or digital signals transmitted via a telecommunication line, a wireless or wired communication line, a network represented by the Internet, a data broadcast, and so on.

The present invention may also be implemented as a computer system including a microprocessor and a memory, in which the memory stores the aforementioned computer program and the microprocessor operates according to the computer program.

Furthermore, it is also possible to execute another independent computer system by transmitting the programs or the digital signals recorded on the aforementioned recording media, or by transmitting the programs or digital signals via the aforementioned network and the like.

(5) The above-described embodiments and variations may be combined.

The preset invention is not limited to these embodiments and variations. The present invention includes various modifications that persons skilled in the art may be made in these exemplary embodiments and variations and embodiments obtained by combining structural elements of different embodiments and variations, within the principles and spirit of the present invention.

The encoding and decoding system according to the present invention is applicable as a system which makes it possible to encode a speech signal and an audio signal with a low bit rate to generate a high-quality encoded signal, to thereby minimize deterioration in service quality in case transmission is temporarily stopped. More specifically, the encoding and decoding system according to the present invention can be applied to perform a speech or audio streaming service on an unstable communication network such as a mobile communication, a realistic tele-conference, or a broadcasting service for mobile terminals.

REFERENCE SIGNS LIST

200 Packet loss
201, 202, 203, 204, 601-603, 701-706 Frame
300 Encoding and decoding system
301 Characteristic determining unit
302 Encoder
303 Superimposing unit
304 Transmitting unit
305 Decoder
307 Receiving unit
308 Packet loss detecting unit
401, 402, 403 Packet data
501 Packet loss information
502 Packet loss occurrence rate calculating unit
503 Network status storing unit
504 Packet loss determining unit
505 Network delay amount calculating unit
506 Delay measuring counter
800 Packet loss
801 Notification
802 Packet loss period

The invention claimed is:

1. An encoding and decoding system which encodes a sound signal into an encoded signal and decodes the encoded signal, the encoding and decoding system comprising:

a characteristic determining unit configured to determine whether the sound signal is a speech signal or an audio signal, based on an audio characteristic of the sound signal;

an encoder which encodes the sound signal by performing a speech signal encoding process when the sound signal is determined to be the speech signal by the characteristic determining unit, and encodes the sound signal by performing an audio signal encoding process when the sound signal is determined to be the audio signal by the characteristic determining unit;

a transmitting unit configured to transmit the encoded signal;

a receiving unit configured to receive the encoded signal transmitted by the transmitting unit;

a decoder which decodes the encoded signal received by the receiving unit; and a packet loss detecting unit configured to detect a loss of data of the encoded signal in the reception of the encoded signal by the receiving unit, and transmit a notification indicating the loss of the data to the characteristic determining unit, wherein, when receiving the notification indicating the loss of the data, the characteristic determining unit is configured to cause the encoder to change encoding process so as to encode a portion of the sound signal to have a predetermined structure, and the portion encoded to have the predetermined structure in the encoded signal corresponds to one or more frames generated by the encoder encoding the sound signal, and the encoder changes from encoding frames that are dependently decodable to frames that are independently decodable after the notification is received so that all frames of the sound signal are independently decodable by the decoder.

2. The encoding and decoding system according to claim 1, wherein, when receiving the notification indicating the loss of the data, the characteristic determining unit is configured to cause the encoder to encode the portion of the sound signal to have the predetermined structure by performing the speech signal encoding process.

3. The encoding and decoding system according to claim 1, wherein, when receiving the notification indicating the loss of the data, the characteristic determining unit is configured to cause the encoder to encode the portion of the sound signal to have the predetermined structure by performing the audio signal encoding process.

4. The encoding and decoding system according to claim 1, wherein, when receiving the notification indicating the loss of the data, the characteristic determining unit is configured to:

cause the encoder to encode the portion to have the predetermined structure by performing the speech signal encoding process, when determining that the sound signal is the speech signal; and cause the encoder to encode the portion to have the predetermined structure by performing the audio signal encoding process, when determining that the sound signal is the audio signal.

5. The encoding and decoding system according to claim 2, wherein the portion encoded to have the predetermined structure in the encoded signal corresponds to one or more frames, and all of the frames are frames encoded according to Algebraic Code Excited Linear Prediction.

6. The encoding and decoding system according to claim 3, wherein the portion encoded to have the predetermined structure in the encoded signal corresponds to one or more frames, and all of the frames are frames each having initialized context information.

7. The encoding and decoding system according to claim 1, wherein the packet loss detecting unit is configured to:

measure network delay amounts each indicating a time duration from the transmission of the encoded signal by the transmitting unit to the reception of the encoded signal by the receiving unit;

calculate an average network delay amount from the network delay amounts within a predetermined time period; and when the average network delay amount is larger than a predetermined threshold value, transmit the notification indicating the loss of the data to the characteristic determining unit.

8. The encoding and decoding system according to claim 1, wherein the packet loss detecting unit is configured to detect the loss of the data, based on a data number which is included in the encoded signal received by the receiving unit, and when a data loss occurrence rate within the predetermined time period is higher than the predetermined threshold value, transmit the notification indicating the loss of the data to the characteristic determining unit.

9. The encoding and decoding system according to claim 1, wherein, in a packet loss period which is a period from the transmission of the notification indicating the loss of the data by the packet loss detecting unit to the reception by the receiving unit of the signal generated by encoding the portion to have the predetermined structure, the decoder decodes the portion which is independently decodable in the encoded signal received by the receiving unit in the packet loss period.

10. A decoding apparatus included in the encoding and decoding system according to claim 1, the decoding apparatus comprising:

the receiving unit;

the decoder; and the packet loss detecting unit.

11. An encoding apparatus included in the encoding and decoding system according to claim 1, the encoding apparatus comprising:

the characteristic determining unit;

the encoder;

the transmitting unit; and the packet loss detecting unit.

12. The encoding and decoding system according to claim 1, wherein the encoder changes from encoding frames that are dependently decodable to frames that are independently decodable from when the notification is received to when the loss of the data is stopped so that all frames of the sound signal are independently decodable by the decoder.

13. An encoding and decoding method for encoding a sound signal into an encoded signal, and decoding the encoded signal, the encoding and decoding method comprising:

determining whether the sound signal is a speech signal or an audio signal, based on an audio characteristic of the sound signal;

encoding the sound signal by performing a speech signal encoding process when the sound signal is determined to be the speech signal in the determining, and encoding the sound signal by performing an audio signal encoding process when the sound signal is determined to be the audio signal in the determining;

transmitting the encoded signal;

receiving the encoded signal transmitted in the transmitting;

decoding the encoded signal received in the receiving; and detecting a loss of data of the encoded signal in the reception of the encoded signal in the receiving, wherein, when receiving the notification indicating the loss of the data, causing a portion of the sound signal to be encoded to have a predetermined structure, and the portion encoded to have the predetermined structure in the encoded signal corresponds to one or more frames generated by the encoding the sound signal, and the encoding changes from encoding frames that are dependently decodable to frames that are independently decodable after the notification is received so that all frames of the sound signal are independently decodable in the decoding.

* * * * *